US007389782B2

(12) United States Patent
Jung et al.

(10) Patent No.: US 7,389,782 B2
(45) Date of Patent: Jun. 24, 2008

(54) DISHWASHER AND METHOD OF CONTROLLING THE SAME

(75) Inventors: Tae-Young Jung, Suwon (KR); Sam-Yong Jang, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 993 days.

(21) Appl. No.: 10/237,093

(22) Filed: Sep. 9, 2002

(65) Prior Publication Data

US 2003/0221709 A1 Dec. 4, 2003

(30) Foreign Application Priority Data

Jun. 4, 2002 (KR) ..... 2002-31430

(51) Int. Cl.
*B08B 3/02* (2006.01)

(52) U.S. Cl. ..... 134/56 D; 134/200; 134/210

(58) Field of Classification Search ..... 134/56 D, 134/200, 201
See application file for complete search history.

(56) References Cited

U.S. PATENT DOCUMENTS 1,409,511 A * 3/1922 Amsbary et al. ..... 62/311
1,525,346 A * 2/1925 Warren ..... 352/216
1,678,202 A * 7/1928 Shivers ..... 251/129.12
1,693,200 A * 11/1928 Flint ..... 62/263
1,880,093 A * 9/1932 Huston ..... 62/417
1,972,368 A * 9/1934 Alex ..... 96/121
2,001,828 A * 5/1935 Smith ..... 96/147
2,031,055 A * 2/1936 McKinney ..... 261/30
2,117,570 A * 5/1938 Philipp ..... 62/271
2,162,923 A * 6/1939 Short ..... 62/309
2,212,109 A * 8/1940 Abraham ..... 62/177
2,224,819 A * 12/1940 Hull ..... 62/317
2,272,746 A * 2/1942 Holm-Hansen ..... 96/148
2,556,608 A * 6/1951 Will ..... 239/47
2,557,432 A * 6/1951 Holstedt ..... 96/148
2,765,046 A * 10/1956 Fritz ..... 62/271
2,802,590 A * 8/1957 Tupper ..... 220/522
2,953,357 A * 9/1960 Long ..... 165/263
3,092,122 A * 6/1963 Guth ..... 134/58 D
3,342,211 A * 9/1967 Johnson ..... 137/601.09

(Continued)

FOREIGN PATENT DOCUMENTS

DE 34 43 274 * 5/1986

(Continued)

OTHER PUBLICATIONS

European Patent Office 374 616 Jun. 1990.*

(Continued)

*Primary Examiner*—Frankie L. Stinson
(74) *Attorney, Agent, or Firm*—Staas & Halsey LLP

(57) ABSTRACT

A dishwasher includes a casing arranged within the dishwasher, an odor eliminating material installed within the casing, a shutter which selectively opens a part of the casing to expose the odor eliminating material, and a shutter driving device which operates the shutter. A control unit of the dish washer counts an actual drying time in a drying operation of the dishwasher, and opens the shutter by operating the shutter driving device in response to the counted drying time being equal to or greater than a preset drying time. The odor eliminating material eliminates odors in the dishwasher.

11 Claims, 6 Drawing Sheets

U.S. PATENT DOCUMENTS

| | | | | | |
|---|---|---|---|---|---|
| 3,398,756 | A | * | 8/1968 | Kauffman | 134/58 R |
| 3,435,537 | A | * | 4/1969 | Rumsey, Jr. | 34/72 |
| 3,680,940 | A | * | 8/1972 | Johansson et al. | 312/213 |
| 3,771,761 | A | * | 11/1973 | Standke | 251/129.12 |
| 3,876,469 | A | * | 4/1975 | Schimke | 134/95.2 |
| 4,111,655 | A | * | 9/1978 | Quincey | 422/124 |
| 4,268,285 | A | * | 5/1981 | Mason | 96/222 |
| 4,783,048 | A | * | 11/1988 | St. Clair | 251/129.11 |
| 4,955,208 | A | * | 9/1990 | Kawashima et al. | 62/264 |
| 5,062,272 | A | * | 11/1991 | Burns | 62/78 |
| 5,078,971 | A | * | 1/1992 | Matuda et al. | 422/121 |
| 5,129,955 | A | * | 7/1992 | Tanaka | 134/2 |
| 5,174,462 | A | * | 12/1992 | Hames | 220/87.1 |
| 5,195,719 | A | * | 3/1993 | Ball et al. | 251/56 |
| 5,468,447 | A | * | 11/1995 | Bermas | 422/5 |
| 5,660,195 | A | * | 8/1997 | Taylor et al. | 134/58 D |
| 5,740,725 | A | * | 4/1998 | Tomizawa et al. | 100/92 |
| 5,836,324 | A | * | 11/1998 | Johnson et al. | 134/58 D |
| 5,988,520 | A | * | 11/1999 | Bitner | 239/6 |
| 6,192,922 | B1 | * | 2/2001 | MacGibbon et al. | 137/486 |
| 6,346,143 | B1 | * | 2/2002 | McGowan | 96/117.5 |
| 6,454,841 | B1 | * | 9/2002 | Kaiser | 96/224 |
| 6,569,673 | B1 | * | 5/2003 | Nakagawa et al. | 435/286.6 |
| 6,609,311 | B2 | * | 8/2003 | Hagemann et al. | 34/597 |
| 2003/0046947 | A1 | * | 3/2003 | Ohya et al. | 62/264 |
| 2003/0145483 | A1 | * | 8/2003 | Buhler et al. | 34/437 |
| 2006/0096618 | A1 | * | 5/2006 | Price et al. | 134/25.2 |

FOREIGN PATENT DOCUMENTS

| | | | |
|---|---|---|---|
| DE | 36 09 788 | * | 8/1987 |
| DE | 40 08 144 | * | 9/1990 |
| DE | 39 21 177 | * | 1/1991 |
| FR | 96 16174 | * | 7/1998 |
| JP | 47-40252 | * | 1/1981 |
| JP | 2-168956 | * | 6/1990 |
| JP | 3-126422 | * | 5/1991 |
| JP | 3-297434 | * | 12/1991 |
| JP | 4-144531 | * | 5/1992 |
| JP | 4-161164 | * | 6/1992 |
| JP | 4-338440 | * | 11/1992 |
| JP | 6-313666 | * | 11/1994 |
| JP | 7-79906 | | 3/1995 |
| JP | 9-26256 | * | 1/1997 |
| JP | 11-61940 | * | 3/1999 |
| JP | 11-206483 | * | 8/1999 |
| JP | 11-325705 | * | 11/1999 |
| JP | 2000-23893 | * | 1/2000 |
| JP | 2002-295949 | * | 10/2002 |

OTHER PUBLICATIONS

European Patent Office 521 815 Jan. 1993.*
European Patent Office 0 521 815 Jan. 1993 (Translation).*
Appeal Decision of the Rejection issued by the Japanese Patent Office (7 pages).

* cited by examiner

DISHWASHER AND METHOD OF CONTROLLING THE SAME

CROSS-REFERENCE TO RELATED APPLICATIONS

This application claims the benefit of Korean Patent Application No. 2002-31430 filed on Jun. 4, 2002, in the Korean Industrial Property Office, the disclosure of which is incorporated herein by reference.

BACKGROUND OF THE INVENTION

1. Field of the Invention

The present invention relates to dishwashers, and more particularly, to a dishwasher which removes unpleasant odors within the dishwasher and a method thereof.

2. Description of the Related Art

Generally, dishwashers are devices which wash dishes by supplying wash water in a washing tub of the dishwasher, and injecting the wash water through injection nozzles while circulating the wash water in the washing tub to coincide with washing, rinsing and drying operations.

In such a dishwasher, after a washing is completed, food dregs remain in a drain filter within the washing tub. In such a case, odors generated from the food dregs filtered by the drain filter permeate throughout a dish washing space, and cause unpleasantness to a user.

Therefore, various methods of removing the unpleasant odors within the dish washing space have been proposed.

FIG. 1 shows a vertical sectional view of a conventional dishwasher which prevents unpleasant odors within a dish washing space.

The conventional dishwasher comprises a casing 1 having a washing tub 2 formed therein, and a door 3 to selectively open and close a front opening of the dishwasher in a vertically rotating manner.

Upper and lower dish baskets 4 and 5, which accommodate dishes to be washed, are removably arranged in upper and lower portions within the washing tub 2, respectively. Upper and lower injection nozzles 6 and 7 are supplied with wash water, and inject the wash water into the upper and lower dish baskets 4 and 5, respectively. The upper and lower injection nozzles 6 and 7 are positioned under the corresponding upper and lower dish baskets 4 and 5.

A feed motor 8 is arranged under the washing tub 2 and supplies the wash water to the washing tub 2. Feed pipes 9 are respectively connected to upper and lower portions of the washing tub 2 and enable the wash water to be supplied to the washing tub 2 by the feed motor 8. A drain filter 10 is formed in the lower portion of the washing tub 2 and filters food dregs.

An air-flow hole (not shown), which controls the inflow/outflow of air into/from the washing tub 2, and a communicating vessel 11, which allows the washing tub 2 and the outside of the casing 1 to mutually communicate with each other, are connected to a portion of the washing tub 2. A net-shaped dreg removing member 12 is installed in an inlet of the communicating vessel 11.

The communicating vessel 11 includes an adsorption member 13 which adsorbs and eliminates odors of air passing through the adsorption member 13 from a dish washing space, a heater 14 which is installed to surround the adsorption member 13, and an insulating material 15 which is formed to surround the heater 14 and insulates the communicating vessel 11 from overheating.

The communicating vessel 11 further includes an exhaust fan 16 which discharges the air flowing from the dish washing space to the outside of the dishwasher. A filter 17 is disposed between the adsorption member 13 and the exhaust fan 16, and eliminates food odors remaining in the air passing through the adsorption member 13.

With the dishwater having the above construction, where a washing procedure of dishes is completed, food dregs remain in the dish washing space and are filtered by the drain filter 10 arranged in the lower portion of the washing tub 2. In such a case, odors generated from the food dregs are sucked into the communicating vessel 11 by the exhaust fan 16. The odors sucked into the communicating vessel 11 pass through the communicating vessel 11, while being adsorbed by the adsorption member 13, which is an activated carbon, installed within the communicating vessel 11.

On the other hand, the heater 14 heats the adsorption member 13 to a high temperature for a predetermined period of time, activating the movement of odor molecules. Accordingly, adsorptive power is improved, further eliminating the odors sucked into the communicating vessel 11. In addition, the odor air filtered by the adsorption member 13 passes through the filter 17 arranged in the downstream of the adsorption member 13. Therefore, the remaining odors, which were not adsorbed by the absorption member 13, can be eliminated. Furthermore, the possibility of food dregs flowing into the communicating vessel 11 along with the air sucked into the communicating vessel 11 is prevented by the net-shaped dreg removing member 12 installed in the inlet of the communicating vessel 11.

As described above, the communicating vessel 11 is connected to the washing tub 2 so as to enable the dish washing space and the outside of the casing 1 to mutually communicate with each other. Additionally, the adsorption member 13 is installed in the communicating vessel 11 to adsorb odors in the air passing through the communication vessel 11 from the dish washing space.

However, the conventional dishwasher having the above construction requires an additional communicating vessel, in which an adsorption member, a heater, an insulating material, an exhaust fan and a filter must be arranged. This complicates the construction and assembly of the dishwasher, and increases the manufacturing costs of the dishwasher.

In addition, the conventional dishwasher is problematic in its efficiency of eliminating the odors because the adsorption member is arranged in the communication vessel located outside of the dish washing space. Thus, it is difficult for the adsorption member to communicate with the air inside the dish washing space. Moreover, the conventional dishwasher is problematic in that, the exhaust fan must be driven excessively at all times to allow the air in the dish washing space to easily communicate, and be sucked through the adsorption member.

SUMMARY OF THE INVENTION

Accordingly, it is an object of the present invention to provide a dishwasher having a space which accommodates an odor eliminating material arranged within the dishwasher and a method controlling the dishwasher thereof. A part of the space is selectively opened or closed to easily allow air in the dishwasher to communicate with the odor eliminating material. The present invention simplifies the construction and assembly of the dishwasher, and effectively eliminates food odors in the dishwasher.

Additional objects and advantages of the invention will be set forth in part in the description which follows and, in part, will be obvious from the description, or may be learned by practice of the invention.

To achieve the above and other objects of the present invention, there is provided a dishwasher comprising a casing arranged within the dishwasher, an odor eliminating material, which eliminates odors in the dishwasher, installed within the casing, a shutter which selectively opens a part of the casing to expose the odor eliminating material, and a shutter driving device which operates the shutter.

To achieve the above and other objects of the present invention, there is also provided a method of controlling a dishwasher having a casing arranged within the dishwasher, an odor eliminating material installed within the casing, a shutter which selectively opens a part of the casing to expose the odor eliminating material, and a shutter driving device which operates the shutter, the method comprising determining whether a drying time of a drying operation of the dishwasher is equal to or greater than a preset drying time and opening the shutter in response to the drying time of the drying operation being equal to or greater than the preset drying time.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
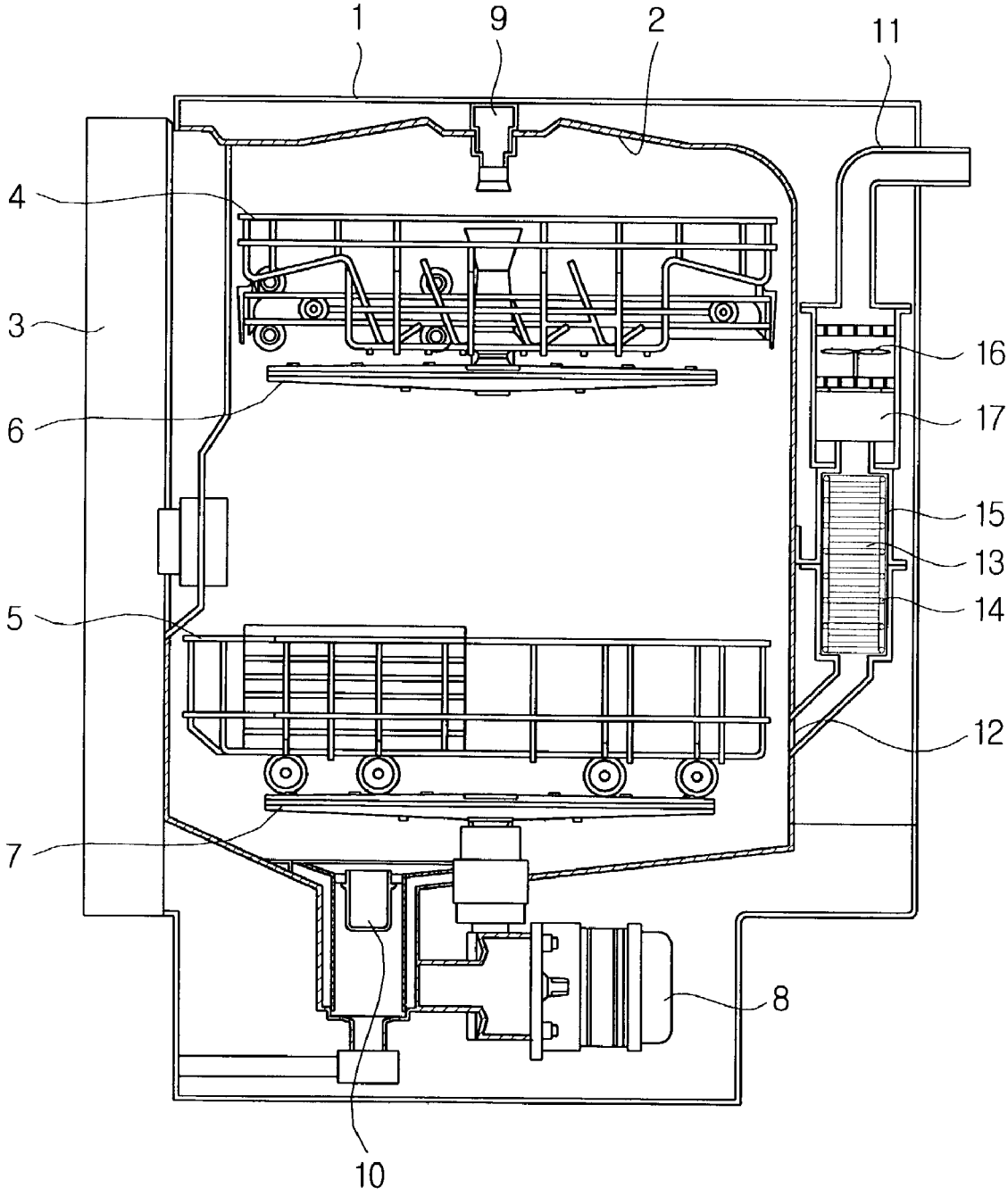
FIG. 1 (Prior Art)
FIG. 1 is a vertical sectional view of a conventional dishwasher.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
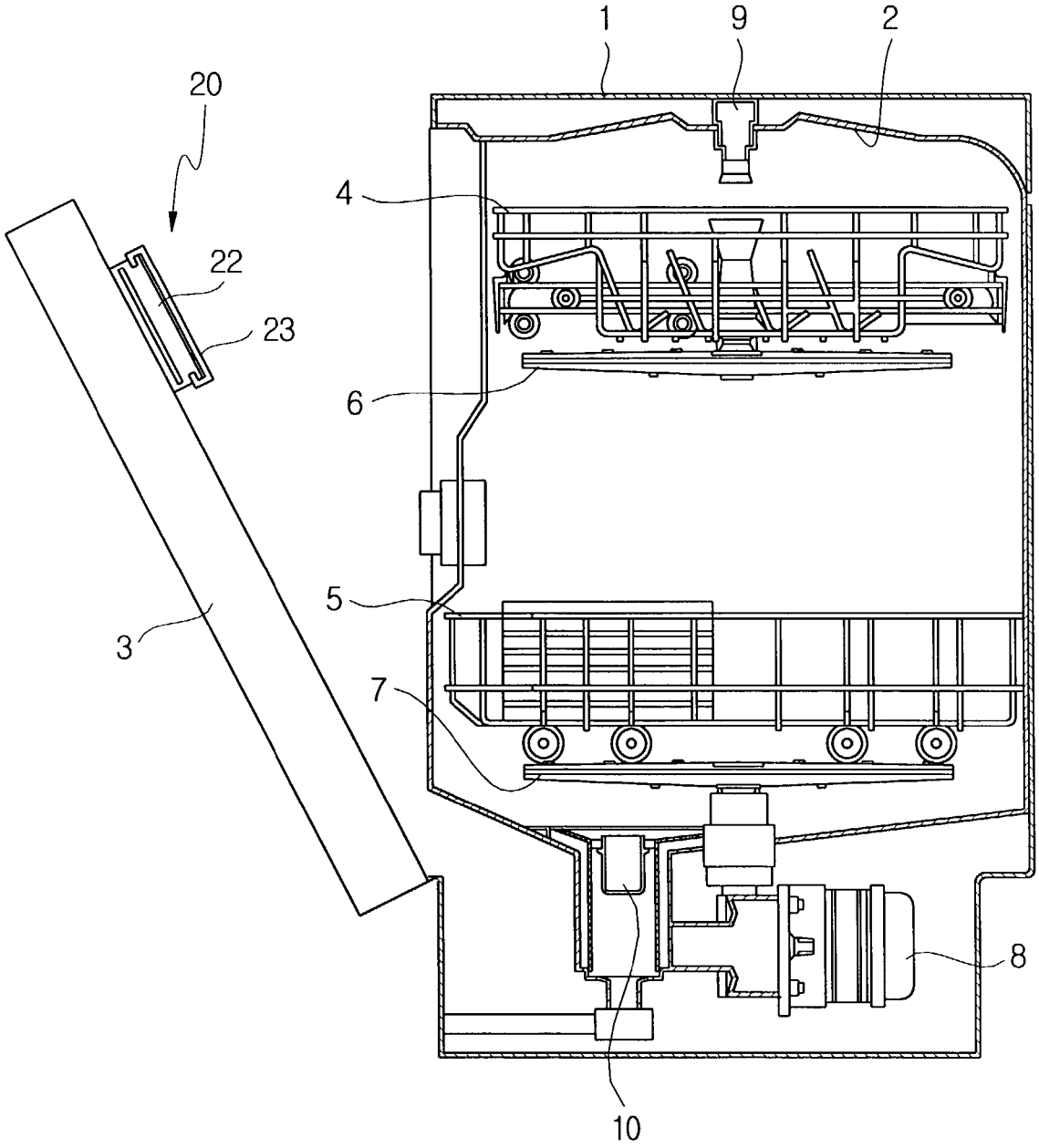
FIG. 2 is a perspective view of a dishwasher according to an embodiment of the present invention.

FIG. 2 shows a perspective view of a dishwasher according to an embodiment of the present invention. The dishwasher includes a door 3 to selectively open and close a front opening of the dishwasher in a vertically rotating manner. Upper and lower dish baskets 4 and 5, which accommodate dishes to be washed, are removably arranged in upper and lower portions within a washing tub 2 of the dishwasher, respectively. Upper and lower injection nozzles 6 and 7, which are supplied with wash water, inject the wash water into the dish baskets 4 and 5, and are respectively provided to the upper and lower dish baskets 4 and 5.

A feed motor 8 is arranged under the washing tub 2 and supplies the wash water to the washing tub 2. Feed pipes 9 are respectively connected to upper and lower portions of the washing tub 2 and enable the wash water to be supplied to the washing tub 2 by the feed motor 8. A drain filter 10 is formed in the lower portion of the washing tub 2 and filters food dregs.

An odor eliminating device 20 is arranged on an inner surface of the door 3. The odor eliminating device 20 comprises a casing 22 which accommodates an odor eliminating material (further described below with reference to FIG. 3A), such as an adsorption member which adsorbs and eliminates odors in air, and an aromatic, a shutter 23 which selectively opens a front portion of the casing 22, and a shutter driving device (not shown) which drives the shutter 23.

A heater, a drain valve and a feed valve (not shown) are installed in the washing tub 2, and a ventilation fan (not shown) is installed in the door 3.

Hereinafter, the odor eliminating device 20 of the present invention will be described in detail.

Figure 3A:
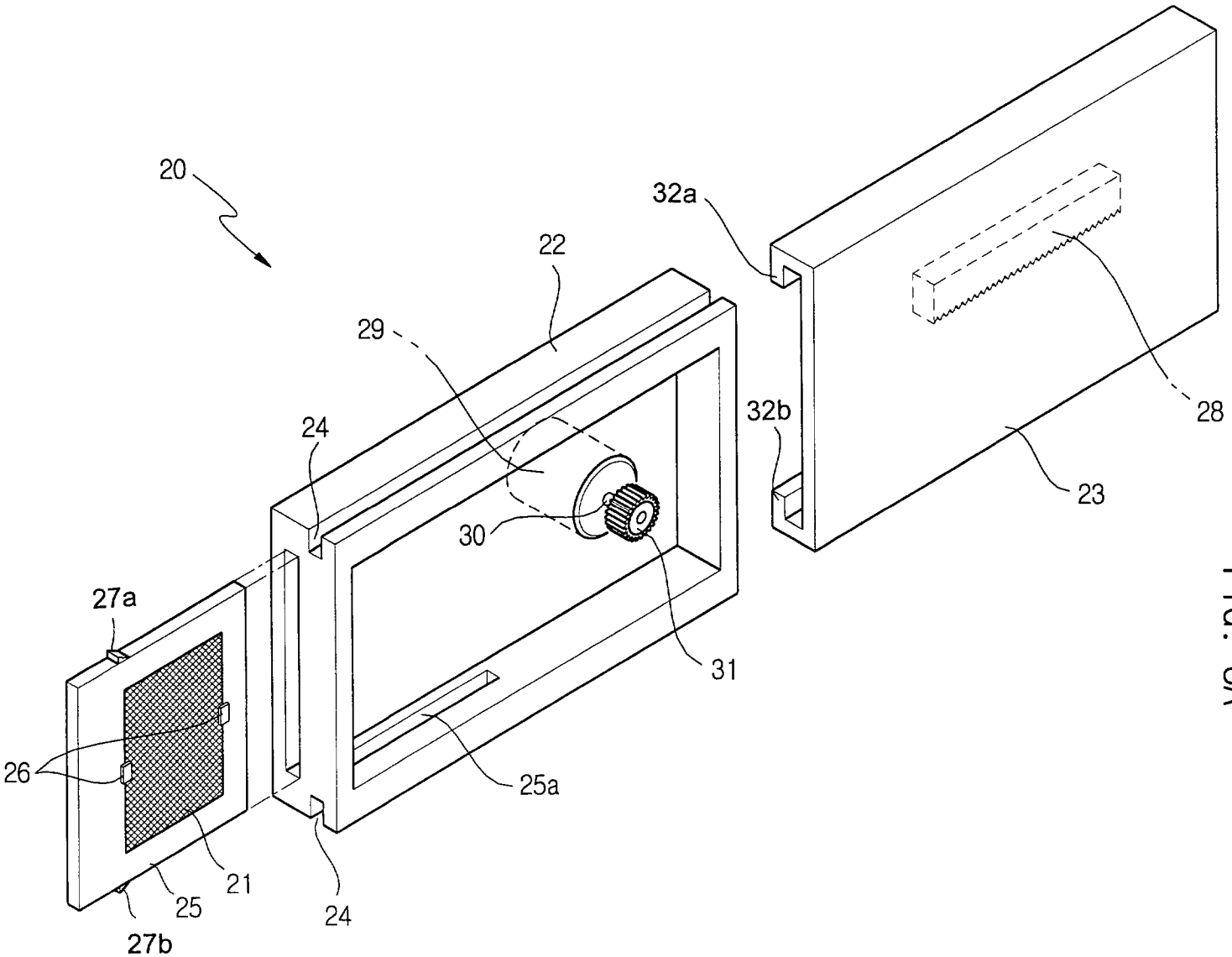
FIG. 3A is a perspective view of an odor eliminating device of the dishwasher shown in FIG. 2.
Figure 3B:
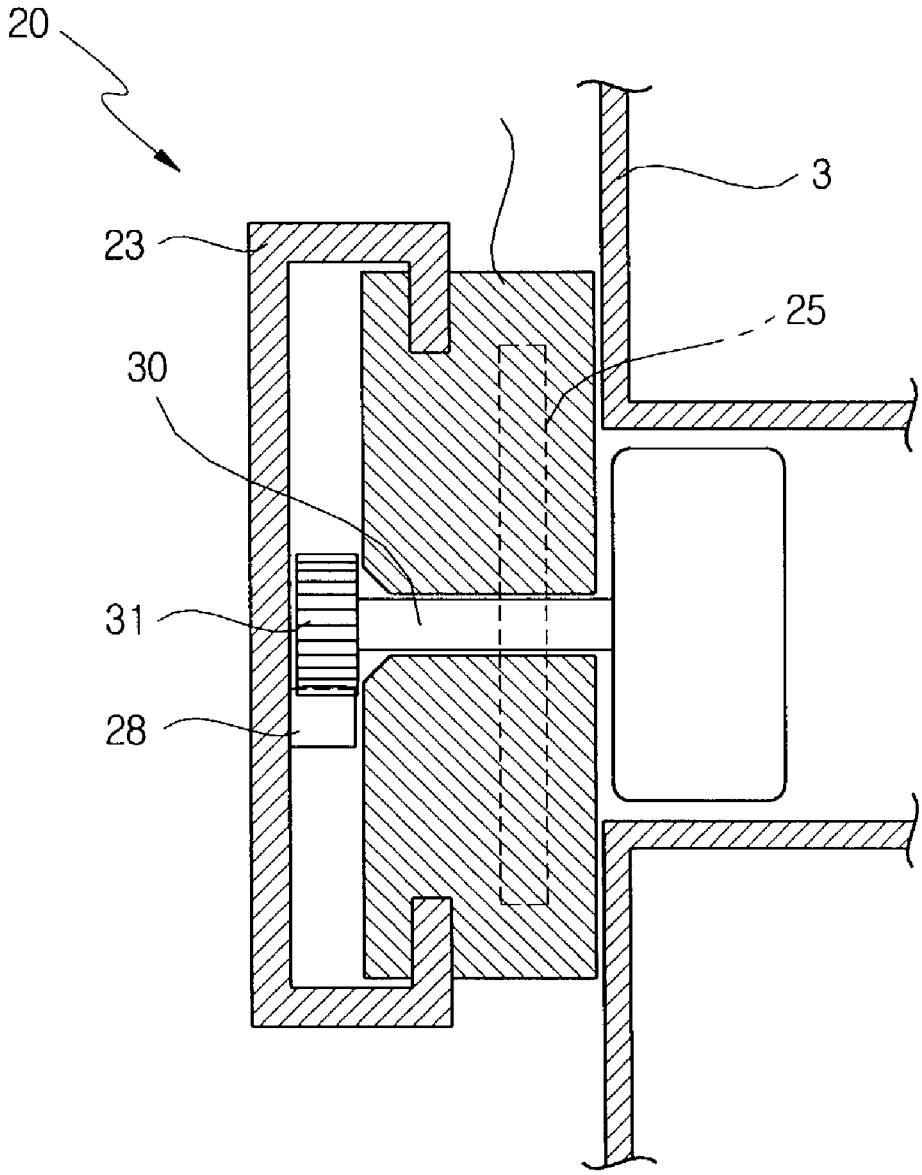
FIG. 3B is a right side view of the odor eliminating device of FIG. 3A.

FIG. 3A shows a perspective view of the odor eliminating device 20 according to the present invention. FIG. 3B shows a right side view of the odor eliminating device 20 of FIG. 3A.

Referring to FIG. 3A and FIG. 3B, the odor eliminating device 20 comprises the casing 22. Guide rails 24 are formed in top and bottom members of the casing 22, and guide the shutter 23 to slide along a longitudinal direction of the casing 22.

A holding plate 25 is removably and slidably inserted through one side member of the casing 22 along guide rails 25*a*. The holding plate 25 is arranged in a back portion of the casing 22. The shutter 23, which selectively opens a front of the casing 22 along the guide rails 24, is arranged to cover the front of the casing 22.

The holding plate 25 includes interlocking projections 26 which mount an odor eliminating material 21 to the holding plate 25. The odor eliminating material 21 eliminates odors in air. The holding plate 25 is constructed so as to have its top and bottom slide along the guide rails 25*a*. The holding plate 25 further includes top and bottom projections 27*a* and 27*b* which are respectively projected from the top and bottom of the holding plate 25 to fix the holding plate 25 along the guide rails 25*a*. The holding plate 25 can be manually moved by a user, thus enabling the holding plate 25 having the odor eliminating material 21 to be attached or detached to/from the casing 22.

The shutter 23 includes a rack 28. A pinion gear 31 is attached to a rotating shaft 30 of a drive motor 29. The pinion gear 31 engages with the rack 28 and enables the shutter 23 to be opened or closed by a forward or reverse rotation of the drive motor 29. The shutter 23 has L-shaped top and bottom projections 31*a* and 32*b* on its top and bottom, respectively. In this case, the top and bottom projections 32*a* and 32*b* are backwardly projected from the top and bottom of the shutter 23, and are combined with the corresponding guide rails 24 to slide along the guide rails 24.

Figure 4:
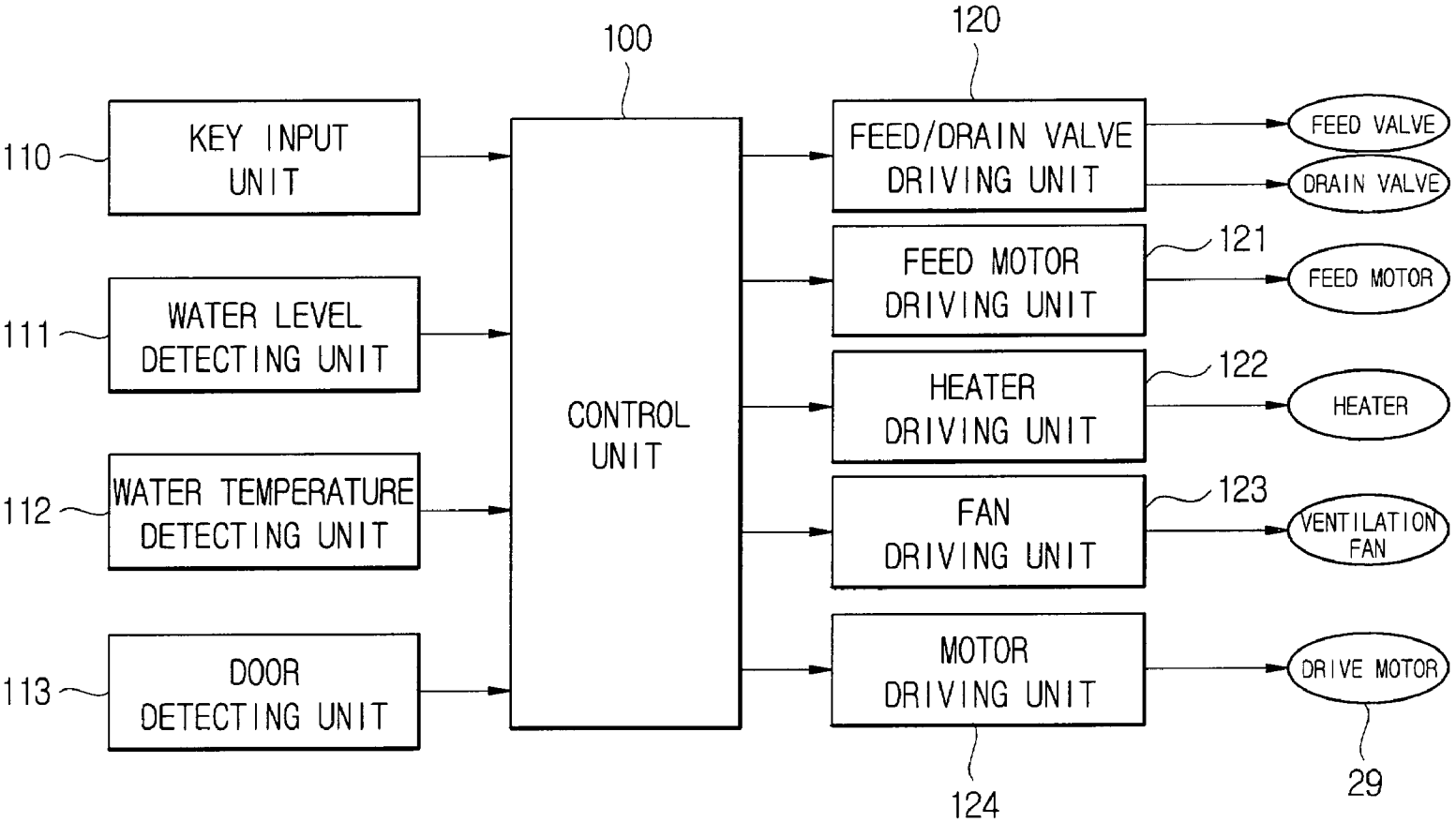
FIG. 4 is a control block diagram of the dishwasher according to the present invention.

FIG. 4 is a control block diagram of the dishwasher according to the present invention. As shown in FIG. 4, an input side of a control unit 100 is electrically connected to a key input unit 110, a water level detecting unit 111, a water temperature detecting unit 112 and a door detecting unit 113. The key input unit 110 is used to input an operating signal for washing, rinsing, and drying operations, which are successive dish washing operations to wash dishes. The water level detecting unit 111 detects water levels of wash water fed into and drained from the dishwasher. The water temperature detecting unit 112 detects a water temperature of the wash water and a drying temperature. The door detecting unit 113 detects whether the door 3 of the dishwasher is opened.

An output side of the control unit 100 is electrically connected to a feed/drain valve driving unit 120, a feed motor driving unit 121, a heater driving unit 122, a fan driving unit 123, and a motor driving unit 124. The feed/drain valve driving unit 120 drives a feed valve, which feeds the wash water into the washing tub 2, and a drain valve, which drains the wash water, in response to a control signal from the control unit 100. The feed motor driving unit 121 drives the feed motor 8, which pumps the wash water to the feed pipes 9, in response to a control signal from the control unit 100.

The feed motor driving unit 121 drives the feed motor 8 to wash and rinse the dishes while injecting the wash water. The heater driving unit 122 operates a heater to heat the wash water to a predetermined temperature, or to dry the dishes after a washing or rinsing operation, in response to a control signal from the control unit 100. The fan driving unit 123 drives a ventilation fan to suck in external air and ventilate the washing tub 2 with the external air in response to a control signal from the control unit 100. The motor driving unit 124 forwardly or reversely rotates a drive motor in response to a control signal from the control unit 100.

Hereinafter, a method of eliminating odors in air within the dishwasher of the present invention is described in detail with reference to FIG. 5.

Figure 5:
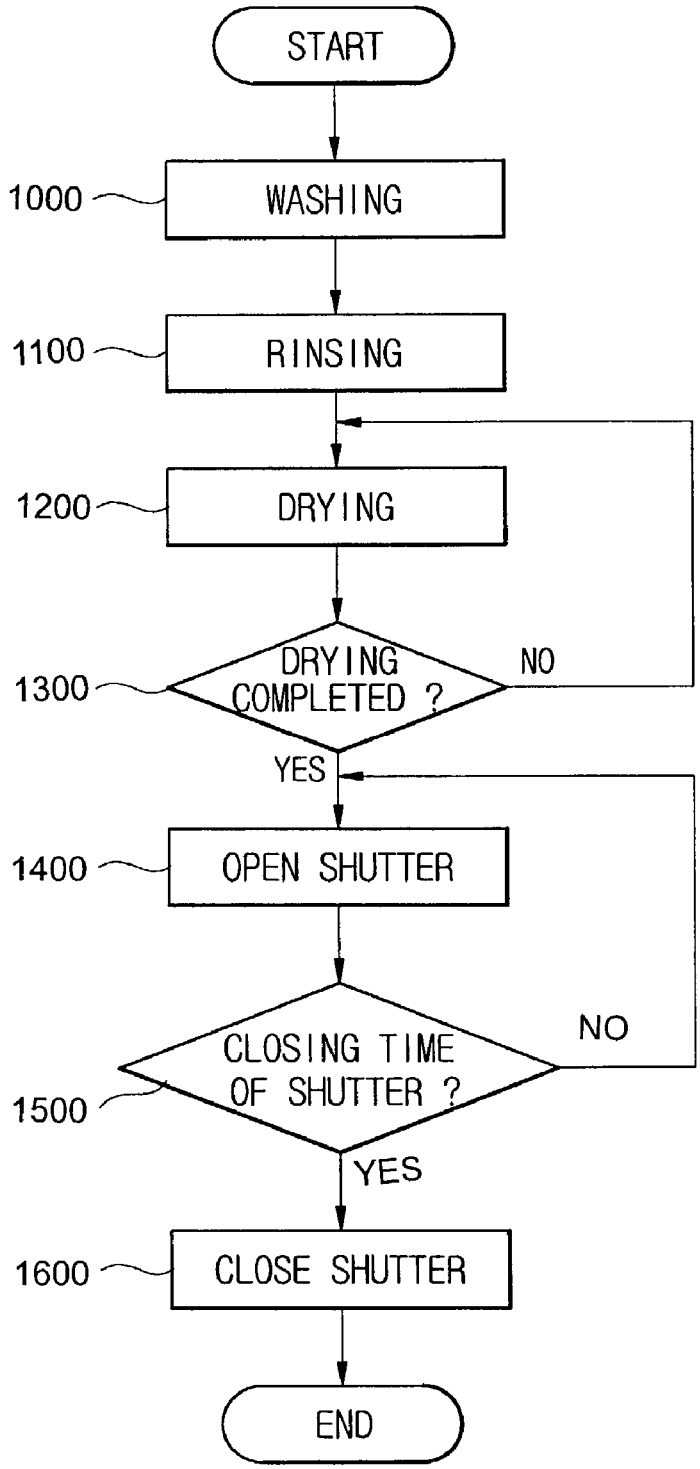
FIG. 5 is a control flowchart of a method of controlling the dishwasher shown in FIG. 2.

FIG. 5 shows a control flowchart of a method of controlling the dishwasher according to the present invention.

Where dishes soiled with food dregs are placed in the washing tub 2 of the dishwasher, and an operating signal for washing, rinsing and drying operations is input to the key input unit 110, the control unit 100 controls the operating signal input using a preset program. Furthermore, the control unit 100 opens the feed valve through the feed/drain valve driving unit 120 to feed wash water into the washing tub 2, and drives the heater through the heater driving unit 122 to heat the fed wash water until the wash water reaches a preset temperature. Where the water level and temperature of the fed wash water reach the preset water level and preset water temperature, respectively, on the basis of output signals of the water level detecting unit 111 and the water temperature detecting unit 112, the control unit 100 drives the feed motor 8 through the feed motor driving unit 121 to pump the wash water into the feed pipes 9. The pumped wash water is provided to the injection nozzles 6 and 7 through the feed pipe 9. The wash water is brought into contact with the dishes while being discharged through the injection nozzles 6 and 7, thus enabling the dishes to be washed in operation 1000.

In response to elapse of a preset washing time and completion of the washing operation 1000, the control unit 100 opens the drain valve through the feed/drain valve driving unit 120 to discharge the contaminated wash water to the outside. Accordingly, food dregs are collected in the drain filter 10. Then, the control unit 100 re-opens the feed valve to feed wash water to a preset rinsing water level. Where the feeding of the wash water is completed, the control unit 100 drives the feed motor 8 through the feed motor driving unit 121 to rinse the dishes while discharging the wash water though the injection nozzles 6 and 7 for a preset rinsing time in operation 1100.

In response to elapse of the preset rinsing time and completion of the rinsing operation 1100, the control unit 100 opens the drain valve through the feed/drain valve driving unit 120 to discharge the contaminated wash water to the outside. Furthermore, the control unit 100 drives the heater and the ventilation fan through the heater driving unit 122 and the fan driving unit 123 to heat the wet dishes using the heater and ventilate the heated dishes by sucking in external air, respectively, thereby drying the dishes for a preset drying time in operation 1200.

In operation 1300, the control unit 100 determines whether an odor elimination in the dishwasher is required on the basis of the drying time of the drying operation. In this case, the control unit 100 counts an actual drying time in the drying operation, compares the counted drying time with the preset drying time, and determines that the odor elimination is required in response to the counted drying time being equal to or greater than the preset drying time.

Where the odor elimination is required, the control unit 100 outputs an opening signal to open the shutter 23 through the motor driving unit 123, which forwardly rotates the drive motor 29, so as to eliminate odors in the air within the dishwasher. At this time, the pinion gear 31 attached to the rotation shaft 30 of the drive motor 29 and engaged with the rack 28 formed on the shutter 23 is rotated by the forward rotation of the rotation shaft 30 of the driving motor 29, so as to open the shutter 23 in operation 1400. Accordingly, the odors in the air within the dishwasher and the odor eliminating material 21 (i.e., an adsorption member, or an aromatic) communicate with each other to eliminate the odors in the air.

Where the shutter 23 is opened in the operation 1400, the control unit 100 determines whether the odor elimination is completed on the basis of an opening time of the shutter 23 in operation 1500. In this case, the control unit 100 counts the opening time of the shutter 23, compares the counted opening time with a preset opening time, and determines that the odor elimination is completed in response to the counted opening time being equal to or greater than the preset opening time.

In response to a determination that the odor elimination is completed in the operation 1500, the control unit 100 outputs a closing signal to close the shutter 23 through the motor driving unit 123, which reversely rotates the drive motor 29, so as to prevent water from flowing into the odor elimination material during another washing procedure. In this case, the pinion gear 31 attached to the rotation shaft 30 of the drive motor 29 and engaged with the rack 28 formed on the shutter 23 is rotated by the reverse rotation of the rotation shaft 30 of the driving motor 29, so as to close the opened shutter 23 in operation 1600.

As described above, the present invention provides a dishwasher which effectively eliminates odors within the dishwasher while having a simplified construction and assembly. Accordingly, the manufacturing cost of the dishwasher is reduced.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A dishwasher, comprising:

a washing tub formed to the dishwasher;

a door to selectively open the washing tub;

a casing arranged on an inner surface of the door;

an odor eliminating material, which eliminates odors in the dishwasher, installed within the casing;

a shutter which selectively opens a part of the casing to expose the odor eliminating material;

a shutter driving device which operates the shutter, the shutter driving device comprising a control unit to control the shutter to open or close based upon a drying time of a drying operation of the dishwasher; and a ventilation fan installed to the door, provided separately from the casing, which allows communication between an inside of the dishwasher and the outside, wherein the casing comprises a holding plate which accommodates the odor eliminating material and a guide rail which is formed in one or more portions of the casing, and slidably receives the holding plate.

2. The dishwasher according to claim 1, wherein:

the shutter includes a rack formed on a back of the shutter, and the shutter driving device comprises:

a rotation shaft;

a drive motor which rotates the rotation shaft in response to an external opening signal; and a pinion gear which is attached to the rotation shaft, and engages with the rack.

3. The dishwasher according to claim 2, wherein the control unit outputs the external opening signal to the drive motor.

4. The dishwasher according to claim 3, further comprising:

a washing tub to contain dish therein, wherein the casing is exposed within the washing tub;

a heater which heats wash water supplied to the dishwasher;

a drain valve which drains the wash water to the outside;

a feed valve which supplies the wash water to the dishwasher;

an injection nozzle which injects the wash water to the dish;

a feed motor which supplies the wash water to the injection nozzle; and a ventilation fan which allows communication between the washing tub and the outside.

5. The dishwasher according to claim 4, wherein the control unit comprises:

a feed/drain valve driving unit which drives the feed valve and the drain valve;

a feed motor driving unit which drives the feed motor;

a heater driving unit which operates the heater;

a fan driving unit which drives the ventilation fan; and a motor driving unit which rotates the drive motor, wherein the control unit controls the feed/drain valve driving unit, the feed motor driving unit, the heater driving unit, and the motor driving unit.

6. The dishwasher according to claim 5, wherein the control unit further comprises:

a key input unit to input signals to operate the dishwasher;

a water level detecting unit which detects a water level of the wash water;

a water temperature detecting unit which detects a water temperature of the wash water and a drying temperature of the washing tub; and a door detecting unit which detects whether an opening of the washing tub is opened, wherein the control unit communicates with the key input unit, the water level detecting unit, the water temperature detecting unit, and the door detecting unit.

7. The dishwasher according to claim 1, wherein the odor eliminating material is an adsorption member which adsorbs and/or eliminates the odors in air within the dishwasher.

8. The dishwasher according to claim 1, wherein the shutter driving device operates the shutter to open the part of the casing in response to the drying time of the drying operation of the dishwasher being equal to or greater than a preset drying time.

9. The dishwasher according to claim 8, wherein the shutter driving device operates the shutter to close the part of the casing, where the part of the casing is opened, in response to an opening time of the shutter being equal to or greater than a preset opening time.

10. The dishwasher according to claim 1, further comprising a washing tub to contain dish therein, wherein the casing is exposed within the washing tub.

11. The dishwasher according to claim 10, further comprising:

one or more dish baskets arranged within the washing tub to accommodate the dish;

one or more injection nozzles which inject wash water toward the one or more dish baskets;

a feed motor which supplies the wash water to the washing tub; and a drain filter which filters food dregs of the dish separated from the dish.

* * * * *